US007171703B2

(12) United States Patent
Mathis

(10) Patent No.: US 7,171,703 B2
(45) Date of Patent: Feb. 6, 2007

(54) POOL COVER TRACKING SYSTEM

(75) Inventor: Wesley L. Mathis, West Jordan, UT (US)

(73) Assignee: Pool Cover Specialists National, Inc., West Jordan, UT (US)

( * ) Notice: Subject to any disclaimer, the term of this patent is extended or adjusted under 35 U.S.C. 154(b) by 0 days.

(21) Appl. No.: 10/267,464

(22) Filed: Oct. 9, 2002

(65) Prior Publication Data

US 2003/0028960 A1 Feb. 13, 2003

Related U.S. Application Data

(63) Continuation-in-part of application No. 10/142,669, filed on May 8, 2002, now abandoned, and a continuation-in-part of application No. 09/726,243, filed on Nov. 29, 2000, now Pat. No. 6,526,604.

(60) Provisional application No. 60/168,171, filed on Nov. 30, 1999.

(51) Int. Cl.
*E04H 4/10* (2006.01)

(52) U.S. Cl. ..... 4/502; 16/96 R

(58) Field of Classification Search ..... 4/502, 4/498, 500, 503; 16/96 R; 160/271, 272, 160/273.1, 23.1; 384/22, 23, 26, 41; 296/98
See application file for complete search history.

(56) References Cited

U.S. PATENT DOCUMENTS

| | | | | |
|---|---|---|---|---|
| 318,382 | A * | 5/1885 | Lushbaugh | 135/97 |
| 2,815,809 | A | 12/1957 | Jacobs et al. | 4/502 |
| 3,050,743 | A | 8/1962 | Lamb | 4/502 |
| 3,277,498 | A | 10/1966 | Kleinbard et al. | 4/502 X |
| 3,979,782 | A | 9/1976 | Lamb | 4/502 |
| 4,464,801 | A | 8/1984 | Lamb | 4/502 |
| 4,466,144 | A | 8/1984 | Lamb | 4/503 |
| 4,937,667 | A | 6/1990 | Choquet | |
| 4,939,798 | A | 7/1990 | Last | 4/502 |
| 5,093,721 | A | 3/1992 | Rabii | |
| 5,592,231 | A | 1/1997 | Clatanoff | |
| 5,786,862 | A | 7/1998 | Kim | |
| 5,845,343 | A | 12/1998 | Last | 4/502 |
| 5,920,922 | A | 7/1999 | Ragsdale et al. | 4/502 |
| 5,950,253 | A | 9/1999 | Last | 4/502 |
| 6,526,604 | B1 * | 3/2003 | Mathis | 4/502 |

* cited by examiner

*Primary Examiner*—Robert M. Fetsuga
(74) *Attorney, Agent, or Firm*—Clayton, Howarth & Cannon, P.C.

(57) ABSTRACT

A track assembly for flexible pool covers. The track assembly includes track members, and securing pieces for being secured to the pool deck and for splicing the track members together in an end-to-end series. The securing pieces are designed to reside beneath, and to be concealed by, the tracking members. The securing pieces may be attached to a pool deck with fasteners, after which the track members may be snapped downwardly onto the securing pieces to thereby secure the track members to said securing pieces. The track members conceal the securing pieces, and the fasteners that secure the securing pieces to the pool deck, thereby providing an aesthetic appearance of continuous tracking uninterrupted by fasteners, fastener holes, or other through holes. This arrangement prevents the fasteners from coming loose and posing a risk to barefooted bathers, because the upward movement of the fasteners is inhibited by the track members that reside above the fasteners.

47 Claims, 4 Drawing Sheets

POOL COVER TRACKING SYSTEM

CROSS-REFERENCE TO RELATED APPLICATIONS

This application is a continuation-in-part of U.S. patent application Ser. No. 09/726,243, filed Nov. 29, 2000, U.S. Pat. No. 6,526,604, entitled "POOL COVER TRACKING SYSTEM," which claimed the benefit of U.S. Provisional Application No. 60/168,171, filed Nov. 30, 1999, and this application is also a continuation-in-part application of U.S. patent application Ser. No. 10/142,669, filed May 8, 2002, entitled "POOL COVER TRACKING SYSTEM," abandoned, the above-referenced applications are all hereby incorporated by reference herein in their entireties, including but not limited to those portions that specifically appear hereinafter, the incorporation by reference being made with the following exception: In the event that any portion of the above-referenced applications is inconsistent with this application, this application supercedes said above-referenced applications.

STATEMENT REGARDING FEDERALLY SPONSORED RESEARCH OR DEVELOPMENT

Not Applicable.

BACKGROUND OF THE INVENTION

1. The Field of the Invention

The present invention relates generally to a track assembly for guiding the placement and removal of flexible enclosure covers, and more particularly, but not entirely, to a pool cover tracking system.

2. Description of Related Art

It is known to provide a retractable pool cover, such as flexible pool cover 32 shown in FIG. 1. The leading edge 62 of the flexible pool cover 32 is guided along parallel tracks, shown schematically in FIG. 1 as items 40. The tracking 40 of the prior art is typically secured directly to the pool deck with screws 42. Some of the disadvantages include the unappealing appearance of screws 42 that disrupt the uniformity and aesthetic appearance of the tracking 40. Further, the tracking screws 42 can come loose and protrude upwardly, posing a danger to barefooted bathers near the pool who might strike their toe or foot against the loose screw, possibly cutting their toe or foot on the loose screw.

The prior art is thus characterized by disadvantages that are addressed by the present invention. The present invention minimizes, and in some aspects eliminates, the above-mentioned failures, and other problems, by utilizing the methods and structural features described herein.

The features and advantages of the invention will be set forth in the description which follows, and in part will be apparent from the description, or may be learned by the practice of the invention without undue experimentation. The features and advantages of the invention may be realized and obtained by means of the instruments and combinations particularly pointed out in the appended claims.

BRIEF DESCRIPTION OF THE DRAWINGS

The above and other features and advantages of the invention will become apparent from a consideration of the subsequent detailed description presented in connection with the accompanying drawings in which.

DETAILED DESCRIPTION OF THE INVENTION

Figure 1:
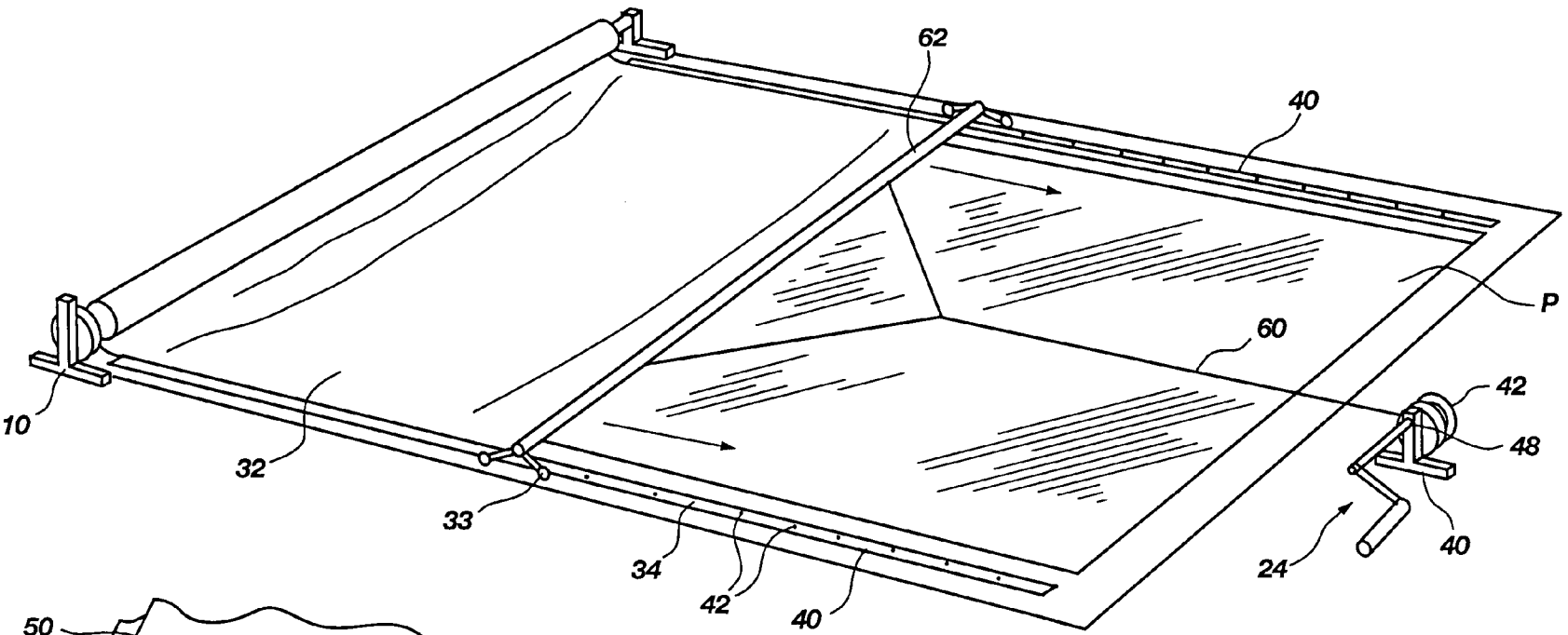
FIG. 1 (PRIOR ART)
FIG. 1 is a schematic view of a prior art flexible pool cover with tracking secured to the pool deck by screws.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

Applicant has discovered that pool cover tracking can be designed to conceal attachment fasteners, thereby producing a more smooth, continuous appearance uninterrupted by fasteners and fastener holes, or other through holes, and is otherwise substantially free of blemishes. Applicant's design also reduces the likelihood of fasteners coming loose, a disadvantage of the prior art that weakens the attachment of the tracking to the pool deck and poses a risk to barefooted bathers who might strike their foot or toe on a loose fastener. As used herein, the term "continuous" will be construed to mean that there are no fasteners, fastener holes, or other through holes in the tracking 50, unless the context clearly dictates otherwise. For example, consistent with the illustrations in FIGS. 2 and 5–7, it will be appreciated that the tracking 50 may comprise a surface that is configured and dimensioned to cover an attachment splice, such that the surface may be substantially free of blemishes and through holes for attaching the tracking 50 to the pool deck 110. Such a configuration for the tracking 50 may allow a swimmers's barefoot to slide across the continuous surface without causing injury, which is advantageous in a pool setting where barefooted swimmers are present.

Figure 2:
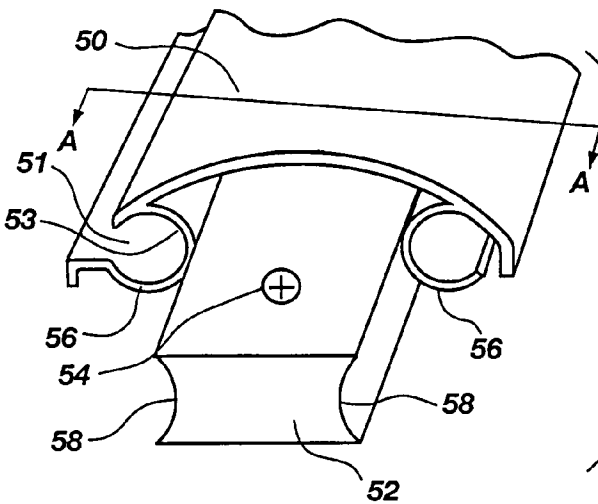
FIG. 2 is a partial, break-away view of a pool cover tracking assembly, made in accordance with the principles of the present invention.

Referring now to FIG. 2, there is shown a break-away view of applicant's tracking design, in the form of tracking 50, sometimes referred to herein as a track member, and an attachment splice 52. Tracking 50 may be manufactured from any lightweight, durable material that exhibits at least a small degree of elasticity, aluminum for example, that is known, or which may become known in the future, in the art for use as part of a pool cover tracking system. As used herein, elasticity may be defined as the ability of a material to return to its original shape or dimensions after the removal of stress forces.

Tracking 50 includes a channel 51 for receiving a movement piece of a flexible pool cover in sliding contact therein, such as movement piece 33 shown in FIG. 1, which may be for example a wheel or other member known in the art for moving a flexible pool cover. The channel 51 is defined by channel walls 53.

The attachment splice 52, also referred to herein as a splicing means or as a securing piece, may be secured directly to the pool deck 110 with screws, bolts, anchors, rivets, nails, dowels, pins, welds, epoxies or other fasteners, collectively referred to herein as fasteners 54. The tracking 50 may then be introduced onto the attachment splice 52 through pressing the tracking 50 downwardly upon the attachment splice 52, causing contacting members, such as grip arms 56, to deflect outwardly as the tracking 50 snaps downwardly onto the attachment splice 52, due at least in part to its elastic properties, over the outer edges 72 and 74 of the attachment splice 52. After the tracking 50 has been pressed over the outer edges 72 and 74 of the attachment splice 52, side arms 56, due to their resiliency, snap-fit into recesses 58, which may be located along the sides of the attachment splice 52 (most clearly illustrated in FIG. 3), causing the tracking 50 to be held firmly against the attachment splice 52, which attachment splice 52 may be firmly secured to the pool deck 110 by the fastener 54 or means for attaching the attachment splice 52 to the pool deck 110. The recesses 58 are defined by recess sidewalls 59.

The snap-fit referred to herein between the tracking 50 and the attachment splice 52 creates a secure connection that permits the tracking 50 to slide, but the attachment splice 52 does not move because the attachment splice 52 may be securely attached to the pool deck 110. The snap-fit further creates an interlock between the tracking 50 and the attachment splice 52 such that removal of the tracking 50 from the attachment splice 52 in an upward direction is extremely difficult without the aid of a tool or instrument. A tool or instrument may be used to "pry" and loosen the tracking 50 from the attachment splice 52, thereby loosening the interlock. The possibility of sliding the tracking 50 will normally be of no consequence because the tracking 50 will be unable to slide as a barrier may be placed against the end of the tracking 50 to inhibit movement of tracking 50. Examples of such a barrier include: the pool cover storage unit, a device that inhibits movement such as an end cap secured to the pool deck 110 or even another piece of tracking 50. Significant upward movement may, therefore, be reduced or inhibited by using the present invention and interlocking the tracking 50 and the attachment splice 52 such that a secure connection may be established.

Figure 5:
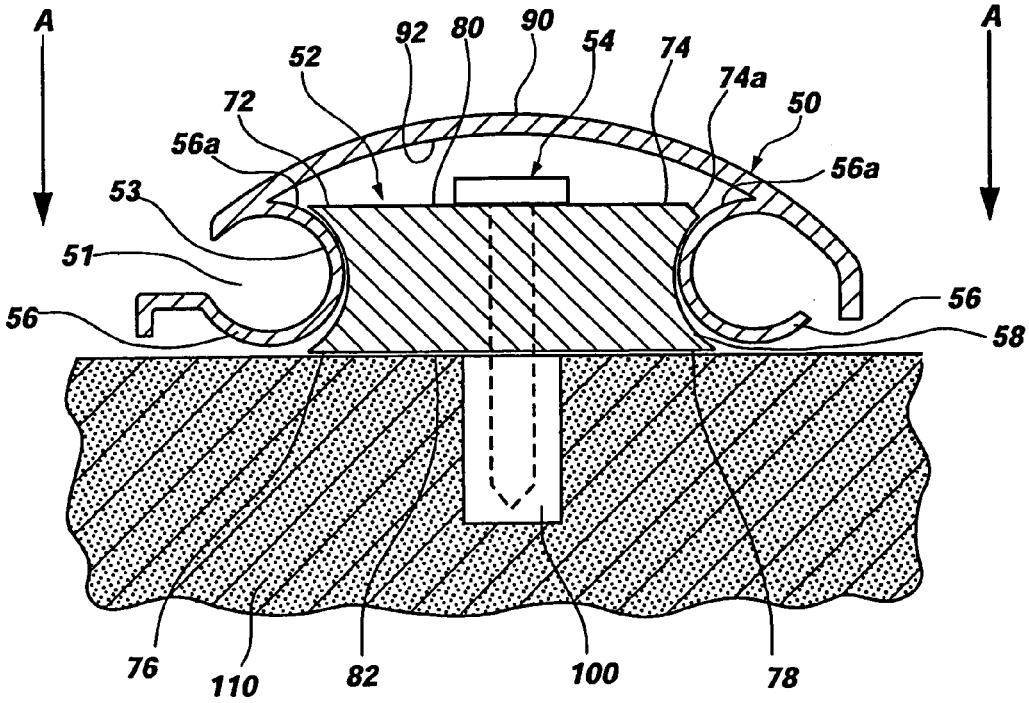
FIG. 5 is a front, cross sectional view of the pool cover tracking assembly, taken along the line A—A in FIG. 2, made in accordance with the principles of the present invention.

Referring now to FIGS. 2 and 5, tracking 50 further comprises a face surface 90 for covering the attachment splice 52 thereby providing an even, continuous surface uninterrupted by fasteners 54, which may not be visible. Additionally, tracking 50 comprises an under surface 92 opposite the face surface 90, wherein the gripping arms 56 may be formed as a part of the under surface 92 and extend below the under surface 92 such that the attachment splice 52 may securely seat between each of the gripping arms 56 when the tracking 50 snaps down over and covers said attachment splice 52. It should be noted that the grip arms 56 may be formed as part of the under surface 92 or may be formed separate from the under surface 92. It should further be noted that tracking 50 may be manufactured from any resilient material that allows the grip arms 56 to deflect radially outward and thereafter return to its original shape causing the grip arms 56 to snap-fit into recesses 58. Tracking 50 may be fabricated from a resilient extruded material that possess an elastic memory which causes the tracking 50 to return to its original shape or position after being distorted. Therefore, the elastic memory of the material comprises the strength necessary for the tracking 50 to maintain its shape and firmly secure itself to the attachment splice 52, and may be flexibly configured such that the grip arms 56 of the tracking 50 may expand outwardly and snap-fit over the top surface 80 of the attachment splice 52 engaging the sidewalls 59 defining the recesses 58, thus securing the tracking 50 to the attachment splice 52.

Figure 3:
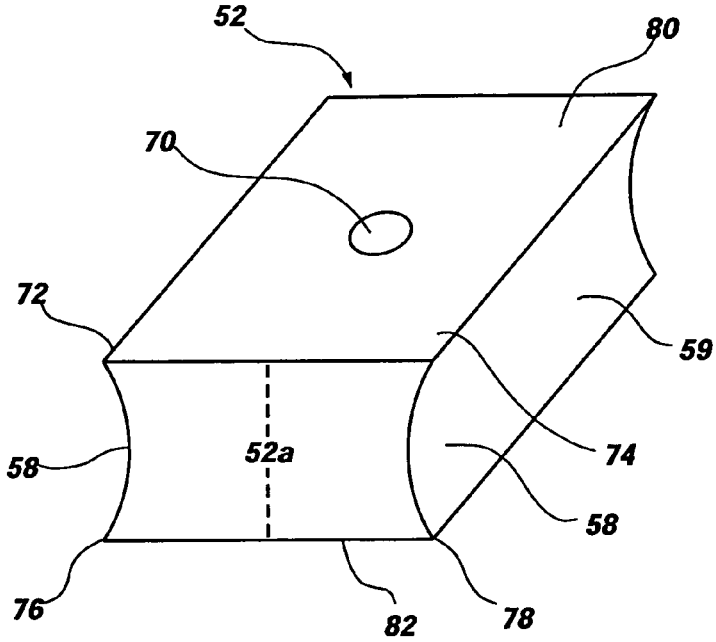
FIG. 3 is a perspective view of an attachment splice for splicing two pieces of tracking, made in accordance with the principles of the present invention.

Referring now to FIGS. 2 and 3, attachment splice 52 operates as a foundation to which tracking 50 may be snap-fitted, thus securing tracking 50 to the pool deck 110. Attachment splice 52 may be made of any durable material, including aluminum and aluminum alloys or other material known in the art for attaching tracking 50 to the pool deck 110. Attachment splice 52 comprises the top surface 80 having two lateral, outer edges 72 and 74 and a bottom surface 82 also having two lateral, outer edges 76 and 78. Outer edges 72 and 74 may be configured, as illustrated in FIG. 3, without a bevel, or may be beveled slightly, as illustrated in FIG. 5 at item 74, in order to allow the tracking 50 to snap down over the top of the attachment splice 52 more easily, in that the bevel surface 74*a* permits grip arm 56 to snap over the attachment splice 52. It will be appreciated that the bevel on the outer edges 72 and 74 may be located on only one of the two outer edges 72 and 74 of the attachment splice 52, as illustrated at item 74*a* in FIG. 5, or may be located on both outer edges 72 and 74 (not illustrated in the figures). Further, the beveled edge 74*a* may be of any suitable length and may be determined by one skilled in the art. Bevel surface 74*a* may have a width that is sized to be 15%–20% of a thickness 52*a* of the attachment splice 52. For example, the bevel surface 74*a* may be 18% of the thickness 52*a* of the attachment splice 52. Further, the bevel surface 74*a* may form an acute angle with respect to the bottom surface 82 of the attachment splice 52 within a range of 40–50 degrees, or for example, 45 degrees. It will further be appreciated that any suitable process that enables the tracking 50 to snap down over the attachment splice 52 may be used and any structure that performs a function the same as or similar to the beveled edge falls within the scope of the present invention.

As illustrated in FIG. 3, a boundary may be formed between the top surface 80 and the bottom surface 82, particularly between lateral edges 72 and 76 and lateral edges 74 and 78. Each boundary may be characterized as having a concave sidewall 59 that defines a partially cylindrical elongate recess 58 separating the top surface 80 from the bottom surface 82. It should be noted that the shape of the recess may be modified by one of skill in the art to match or mate with the shape of the side arms 56, which may also be modified, such that the snap-down feature may occur to interlock the tracking 50 and the attachment splice 52. It will be appreciated, as illustrated in FIG. 3, that the sidewall 59 of each attachment splice 52, or securing piece 52, may be located entirely between the top surface 80 and the bottom surface 82 of each attachment splice 52, or securing piece 52.

Figure 4:
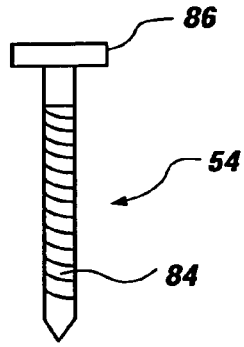
FIG. 4 is a side view of a fastener for attaching the attachment splice to a pool deck, made in accordance with the principles of the present invention.
Figure 6:
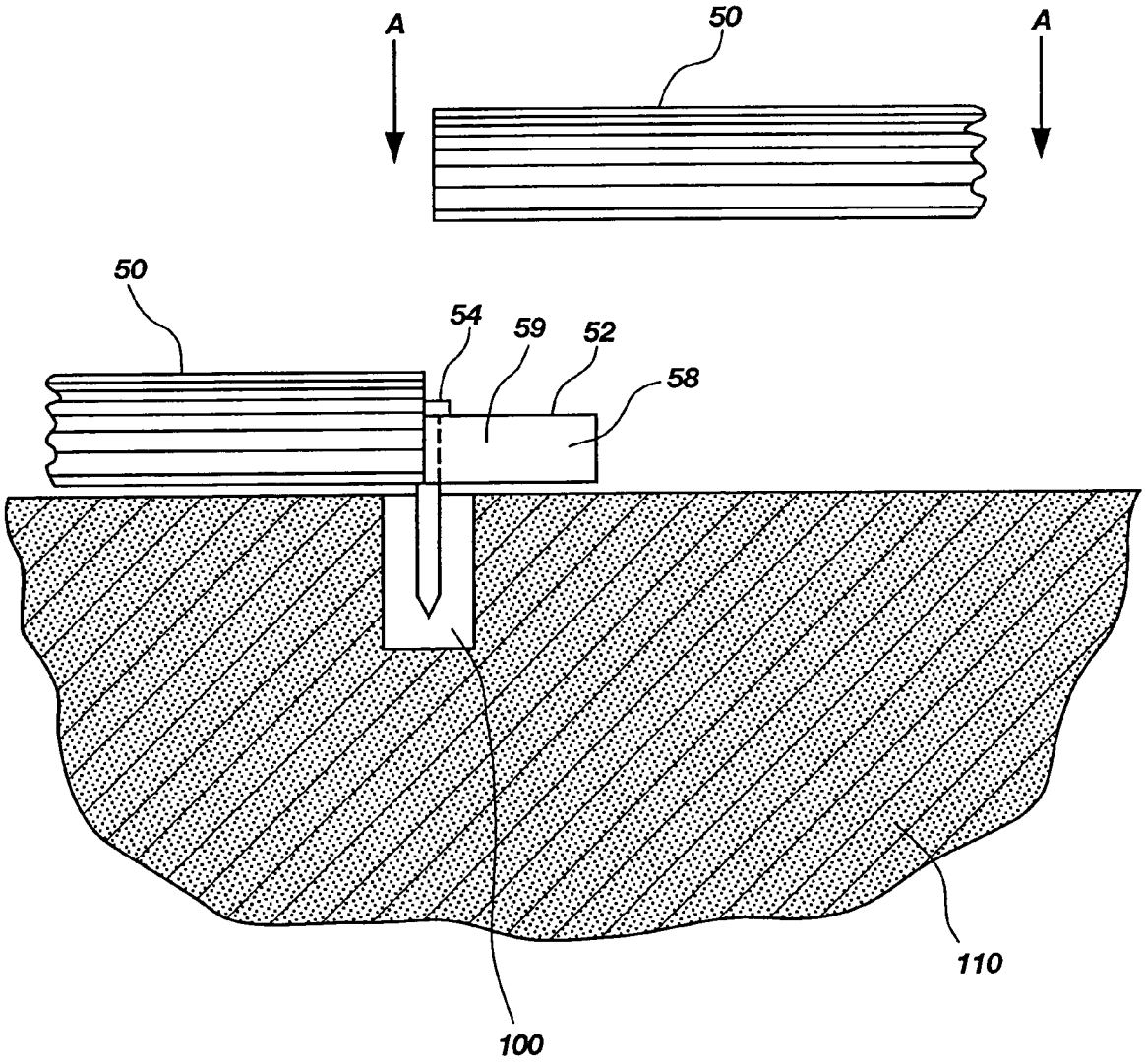
FIG. 6 is a partial side view of the pool cover tracking assembly, made in accordance with the principles of the present invention.

Top surface 80 of attachment splice 52 may be characterized by a sidewall defining an aperture 70, wherein a shaft portion 84 of the fastener 54 (one embodiment of which is illustrated in FIG. 4) may pass through the aperture 70 into an opening of an anchor 100 (illustrated best in FIGS. 5 and 6). The anchor 100 may be inserted into the pool deck 110 in a substantially flush orientation with respect to the pool deck 110 prior to insertion of the fastener 54, after which insertion of the fastener 54 secures the attachment splice 52 to the pool deck 110. It should be noted that the overall shape of the attachment splice 52 may be as shown in FIG. 3 or may be any suitable shape, such as a polygonal or circular shape, such that the attachment splice 52 may secure the tracking 50 to the pool deck 110. Such shapes that may be presently known, or which may become known in the future, in the art are intended to fall within the scope of the present invention.

As previously stated, fasteners 54 may comprise a shaft portion 84 and a head portion 86, wherein said head portion 86 may be configured for engaging the top surface 80 of the attachment splice 52, thus holding the attachment splice 52 firmly against the pool deck 110 when the shaft portion 84 engages the anchor 100. For example, screws, bolts, anchors, rivets, nails, dowels, pins, welds, epoxies or other fasteners are all contemplated by the present invention, and any structure or apparatus that performs the same or similar function as a means for attaching the attachment splice 52 to the pool deck 110 is intended to fall within the scope of the present invention.

Attachment splices 52 may be attached to the pool deck 110 in a series of end-to-end pieces lined in a row such that the tracking 50 may be snap-fitted over the top of the attachment splices 52. Attachment splices 52 may also be attached to the pool deck 110 at spaced intervals lined in a row such that a single piece of tracking 50 may snap down over multiple, spaced attachment splices 52, rather than a series of end-to-end attachment splices 52. Further, a single attachment splice 52 may be attached to the pool deck 110 at a junction of two pieces of tracking 50 for joining and attaching said two pieces of tracking 50 together as illustrated in FIG. 6. When attachment splice 52 is referred to herein as a "securing piece," the intended meaning covers the concept of the piece 52 operating to secure the tracking 50 to the deck 110, regardless of whether the piece 52 also serves to join two pieces of tracking 50.

It should be noted that tracking 50 may be either one continuous piece or may be a series of shorter lengths lined end-to-end and snap-fitted over attachment splice(s) 52 depending upon the length of the pool and the size of the tracking 50. For example, two pieces of tracking 50 may be secured to a single attachment splice 52, as illustrated in FIG. 6, by first snapping down a first piece of tracking 50 over the attachment splice 52 secured to the pool deck 110 and then snapping the second piece of tracking 50 down over the attachment splice 52, as illustrated by motion arrows "A" in FIG. 6. The seam between two pieces of tracking 50 may be covered by a means for covering a junction created by splicing a first piece of tracking 50 with a second piece of tracking 50, for example a fascia, and any structure, apparatus or device for covering a junction of two pieces of tracking 50 is intended to fall within the scope of the present invention.

Anchors 100 may be used for securing the fastener 54 to the pool deck 110 by pressing said anchor 100 into a previously drilled hole formed in the pool deck 110 for eventual securement of the attachment splice 52. Anchors 100 may be made of any suitable material for anchoring a fastener 54 to a pool deck 110, including plastic, metal or metal alloys. Anchors 100 may be inserted into and tapped flush with the deck, such that no raised portion of the anchor 100 extends above the deck surface causing the attachment splice 52 to be elevated in an unwanted fashion. Once the anchor 100 has been secured within the hole in the pool deck 110, the each attachment splice 52 may be positioned and installed to the pool deck 110 by lining up the aperture 70 of the attachment splice 52 with the anchor 100 and inserting the fastener 54 through the aperture 70 into the anchor 100, thereby securing the attachment splice 52 to the pool deck 110. It will be appreciated that a single attachment splice 52 may be positioned over a single hole in the pool deck 110 and secured to an anchor 100 by the fastener 54, or a plurality of attachment splices 52 may be positioned on the surface of the cool deck 110 such that each of the plurality of attachment splices 52 may be positioned over a corresponding hole in the pool deck 110, and secured to a corresponding anchor 100 by the fastener 54.

It should be noted that the present invention may function with or without the anchors 100, so long as the fasteners 54 securely anchor the attachment splices 52 to the pool deck 110, such that the track 50 may be snapped down over and secured to the attachment splices 52. Additionally, it will be appreciated that a variety of anchors may be used to accomplish the stated function, said anchors being well known in the art and may be selected depending upon the type of substrate the attachment splice 52 is to be secured, for example concrete, wood or some other material, and the particular conditions and problems associated with attaching a fastener 54 to a substrate.

Once properly snap-fitted and secured to the attachment splice 52, tracking 50 conceals the fasteners 54, which fasteners 54 have been previously inserted through the aperture 70 located within the attachment splice 52 to secure the attachment splice 52 to the pool deck 110, thus providing an even, continuous and aesthetic appearance. Additionally, by snap-fitting tracking 50 to attachment splice 52 exposure of any loose fasteners 54, which pose a potential danger to swimmers by laceration or otherwise, may thereby be prevented. Likewise, the tracking 50 may function as a cover to prevent the fasteners 54 from loosening in the first place. Although some loosening may occur, complete dislocation of the fastener 54 may be prevented as the under surface 92 of tracking 50, acting as a cover, may interfere with the head portion 86 of the fastener 54 to prevent complete dislocation of the fastener 54 (illustrated best in FIG. 5).

The grip arms 56 may each comprise an outer surface **56*a*, wherein the grip arms 56 and their corresponding outer surfaces 56*a* comprises a partially cylindrical shape, and the channel 51 may also be defined by a partially cylindrical boundary. The recesses 58 may also be defined by a partially cylindrical boundary. It is to be understood that the terms "cylinder" or "cylindrical" as used herein shall be broader in meaning than the phrase "circular cylinder," the latter being limited in meaning to a cylindrical shape being circular in cross section. A cylindrical shape for purposes of this application therefore refers broadly to any three-dimensional elongate shape having an at least partially rounded cross section. It should further be understood that the grip arms 56, the channel 51 and the recesses 58 may be of any suitable shape known, or which may become known in the future, in the art for performing the stated function. For example, any or all of the grip arms 56, the channel 51 and the recesses 58** may be circular, or they may alternatively be square, polygonal or any other suitable shape or configuration.

Figure 7:
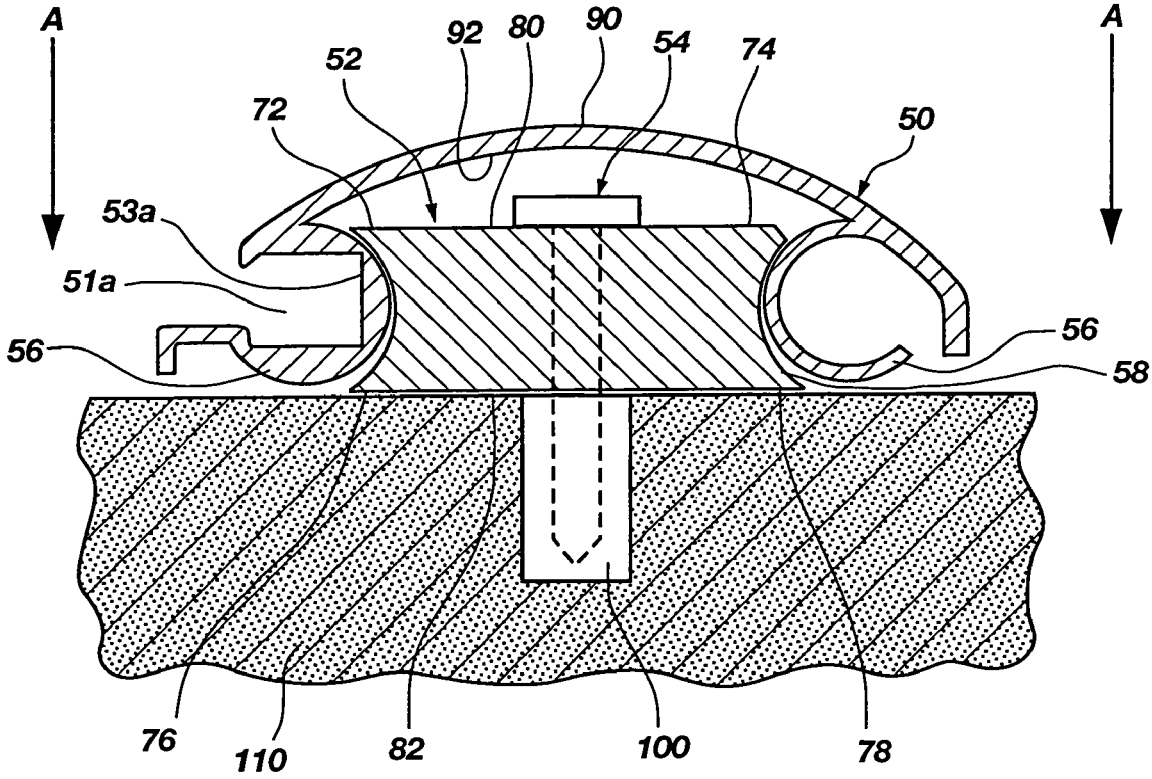
FIG. 7 is a front, cross sectional view of the pool cover tracking assembly, similar to FIG. 5 and taken along the line A—A in FIG. 2, illustrating an alternative embodiment of a channel made in accordance with the principles of the present invention.

FIG. 7 is similar to FIG. 5, with the same reference numerals indicating like structure. Referring now to FIG. 7, wherein an alternative embodiment of channel, referred to herein as 51*a*, is illustrated as having square channel walls 53*a* defining the channel 51*a*. It should be noted that FIG. 7 illustrates only one possible shape of the channel 51 and other embodiments referred to herein are intended to fall within the scope of the present invention.

Aspects of the present invention may also be described as set forth below.

DESCRIPTION OF INVENTION

A means of securing surface-mounted, automatic-pool-cover track ("toptrack") in a manner that eliminates the visibility of the anchoring screws holding the track to the deck, thus permitting the track to have a more aesthetically-pleasing appearance and eliminating the possibility that the track screws could become loose and pose a danger to bathers walking on the pool deck.

Details:

1. ¼" holes, spaced approximately two feet apart, may be drilled into the pool deck on each side of the pool, along a chalked line corresponding to the eventual positioning of surface-mounted, pool cover track. Anchors may then inserted into the drilled holes.

2. Two-inch-long, securing piece, which may be for example aluminum, with a single hole drilled through the center may then be placed above each of the holes drilled into the pool deck. A stainless-steel, anchoring screw, or other fastener, may be inserted into each hole and threaded through the deck-anchor, or other type of anchor, (previously pressed into the ¼" deck holes and tapped flush with the deck). The screws may be tightened, thus fastening the securing pieces to the deck, such that the extrusions run lengthwise to the chalked line.

3. The track sections may be placed along the chalked line, above the in-line, securing pieces. Note: The extrusions may be shaped to permit the track to "snap" down over the top of the securing pieces when the top of the track, positioned directly above the anchoring-extrusion, is tapped lightly with a rubber mallet, fixing the track to the pool deck.

4. The inside edge of each two-inch, securing pieces may be machined precisely to allow the track to snap into place over the securing piece. Additionally, once the automatic pool cover has been installed and the cover fabric inserted into the fabric-channel of the track, the aluminum securing piece may be designed such that when more weight is applied to the surface of the pool cover (i.e., standing water, snow, ice, people walking onto the cover, etc.), the tighter the track is held to the deck.

5. In the event that the track needs to be removed for maintenance to the pool deck or to replace or repair the pool cover fabric, the track can be "pried" loose by inserting a pry-bar to the outside edge of the track.

Advantages/Improvements to Existing Technology:

Existing technology (prior art) requires surface-mounted, pool-cover track to be anchored to the pool deck by means of track screws inserted through pre-drilled holes in the top of the track and into pre-installed concrete anchors which have been tapped flush with the deck. Because the surface-mounted track may be curved on top and configured of minimal thickness, it is impossible to countersink the anchoring holes enough to permit the tops of the track screws to be flush with the track. The screw head, traditionally, sits slightly above the top of the track, creating a hazard to bathers walking on the deck. In addition, over time, factors like ground settling, deck temperature (which causes the track to expand or contract slightly), and motion of the cover moving back and forth tend to cause the track screws to become loosened and, thus, subject to periodic tightening, a maintenance-intensive task. Because the new technology permits the track to be "snapped" down over the top of the securing pieces, covering the screws which fasten the securing pieces to the deck, the risk of stubbing a toe or incurring a laceration may be eliminated completely, and since the two-inch securing pieces are less susceptible to being affected by deck shifting, temperature variations, or motion of the cover (and also "trap" the securing piece screws in place), the track remains tightly secured to the deck, reducing track maintenance considerably and eliminating the possibility of laceration to a bather's foot in the event that the bather steps on the track.

The new technology in accordance with the principles of present invention also creates a much more aesthetically-pleasing "finished" look, since throughout the entire length of the track there are no visible screws. During installations using existing technology, invariably, during the track-anchoring process, sharp edges and "burrs" may be created when the screwdriver or driver bit is used to tighten the screws. To avoid injury to individuals who may step on the track, these burrs have to be individually filed. The new technology eliminates this installation procedure completely, reducing the overall time and effort of the entire installation process.

In the event that the track needs to be removed, either to repair the pool deck or repair/replace the pool cover fabric, existing technology requires the technician to remove every track-anchoring screw (spaced every two feet down each track length), a time-consuming process. The new technology permits the track to be "pried" loose from the outside edge, a process that allows the track to be removed much more quickly than is possible utilizing existing technology.

It will be appreciated that the structure and apparatus disclosed herein to illustrate a tracking means, such as the tracking 50, is merely one example of a tracking means for guiding movement pieces of a flexible pool cover, and it should be appreciated that any structure, apparatus or system for guiding movement pieces that functions the same as, or equivalent to, those disclosed herein are intended to fall within the scope of a tracking means for guiding movement pieces, including those structures, apparatus or systems for guiding which are presently known, or which may become available in the future. Anything which functions the same as, or equivalently to, a tracking means for guiding movement pieces of a flexible pool cover falls within the scope of this element.

It will further be appreciated that the structure and apparatus disclosed herein to illustrate a splicing means, such as attachment splice 52, is merely one example of a means for splicing the track members together in an end-to-end series, and it should be appreciated that any structure, apparatus or system for splicing that functions the same as, or equivalent to, those disclosed herein are intended to fall within the scope of a means for splicing, including those structures, apparatus or systems for splicing which are presently known, or which may become available in the future. Anything which functions the same as, or equivalently to, a means for splicing falls within the scope of this element.

It will likewise be appreciated that the structure and apparatus disclosed herein to illustrate a means for attaching the attachment splice 52 is merely one example of a means for attaching the attachment splice 52 to the pool deck 110, and it should be appreciated that any structure, apparatus or system for attaching the attachment splice 52 which performs functions the same as, or equivalent to, those disclosed herein are intended to fall within the scope of a means for attaching the attachment splice 52, including those structures, apparatus or systems for attaching the attachment splice 52 which are presently known, or which may become available in the future. Anything which functions the same as, or equivalently to, a means for attaching falls within the scope of this element.

It will be appreciated that the structure and apparatus disclosed herein to snap-fit the track member 50 to the attachment splice 52 is merely one example of a means for snap-fitting a track member 50 to the attachment splice 52, and it should be appreciated that any structure, apparatus or system for snap-fitting which performs functions the same as, or equivalent to, those disclosed herein are intended to fall within the scope of a means for snap-fitting, including those structures, apparatus or systems for snap-fitting which are presently known, or which may become available in the future. Anything which functions the same as, or equivalently to, a means for snap-fitting falls within the scope of this element.

In accordance with the features and combinations described above, a useful method of providing a tracking guide for guiding movement pieces of a flexible pool cover includes the steps of:

(a) attaching splicing pieces to a pool deck; and (b) attaching a tracking means for guiding movement pieces of the flexible pool cover to the splicing pieces such that said tracking means resides above, and conceals, the splicing pieces.

Those having ordinary skill in the relevant art will appreciate the advantages provided by the features of the present invention. For example, it is a potential feature of the present invention to provide a tracking that is free of fasteners, fastener holes, or other through holes. It is a further potential feature of the present invention to provide a tracking that is capable of being snapped down over a securing piece that has been secured to a pool deck forming a snap-fit. It is another potential feature of the present invention to provide a tracking that may be released from the snap-fit with the securing piece such that repairs and the like may be accomplished. Another potential feature of the present invention is to provide a securing piece for securing the tracking to the pool deck that has a beveled edge and surface for more easily snapping the tracking over the securing piece.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment, Thus, the following claims are hereby incorporated into this Detailed Description by this reference, with each claim standing on its own as a separate embodiment of the present disclosure.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A track assembly for guiding the placement and removal of a flexible pool cover, said track assembly comprising:

at least one securing piece configured and dimensioned for attachment to each side of a pool deck, said at least one securing piece having a top surface and a bottom surface, and a sidewall defining a first elongate recess;

means for attaching the securing piece to the pool deck; and at least one track member located on each side of the pool deck, wherein the track member comprises a contacting member and a grip arm for matingly engaging the sidewall defining the first elongate recess in a snap-fit;

wherein the at least one securing piece further comprises a beveled edge having a beveled surface for permitting the track member to snap-fit more easily over the at least one securing piece.

2. The track assembly of claim 1, wherein the beveled surface comprises a width that is between a range of 15% to 20% of a thickness of the securing piece.

3. The track assembly of claim 2, wherein the width of the beveled surface is 18% of the thickness of the securing piece.

4. The track assembly of claim 1, wherein the bevel surface forms an acute angle with respect to the bottom surface of the securing piece that is between a range of 40 degrees to 50 degrees.

5. The track assembly of claim 4, wherein the acute angle is 45 degrees.

6. The track assembly of claim 1, wherein the track member includes an under surface, and the grip arm is a first elongate grip arm formed below said under surface, wherein the contacting member is a second elongate grip arm formed below said under surface, and wherein the first elongate grip arm may be configured and dimensioned to grip the sidewall defining the first elongate recess of the securing piece.

7. The track assembly of claim 6, wherein the first and second elongate grip arms may be partially cylindrical in shape, and wherein the first elongate recess may be defined by a partially cylindrical boundary.

8. The track assembly of claim 6, wherein the first and second grip arms may be configured and dimensioned to grip the at least one securing piece therebetween.

9. The track assembly of claim 1, wherein the at least one securing piece further comprises a first side and a second side, the first elongate recess formed in the first side and a second elongate recess defined by a second sidewall formed in the second side.

10. The track assembly of claim 9, wherein the track member includes an under surface, and the grip arm is a first elongate grip arm formed below said under surface and the contacting member is a second elongate grip arm formed below said under surface, wherein the first elongate grip arm may be configured and dimensioned to grip the sidewall defining the first elongate recess and the second elongate grip arm may be configured and dimensioned to grip second sidewall defining the second elongate recess.

11. The track assembly of claim 1, wherein the at least one securing piece further comprises means for splicing the track member to a second track member while the at least one securing piece resides beneath and concealed by said track member and the second track member.

12. The track assembly of claim 1, wherein the at least one securing piece further comprises an aperture formed between the top surface and the bottom surface.

13. The track assembly of claim 1, wherein the track member may be fabricated from an elastic material for resiliently expanding the grip arm over the top surface of the at least one securing piece and then snap-fitting into the first elongate recess.

14. The track assembly of claim 1, wherein the sidewall defining the first elongate recess comprises a concave surface separating the top surface from the bottom surface.

15. The track assembly of claim 1, wherein the sidewall of the at least one securing piece is located entirely between the top surface and the bottom surface of said at least one securing piece.

16. A track assembly for guiding the placement and removal of a flexible pool cover, said track assembly comprising:

at least one securing piece configured and dimensioned for attachment to each side of a pool deck, said at least one securing piece having a top surface and a bottom surface, and a sidewall defining a first elongate recess;

means for attaching the securing piece to the pool deck; and at least one track member located on each side of the pool deck, wherein the track member comprises a contacting member and a grip arm for matingly engaging the sidewall defining the first elongate recess in a snap-fit;

wherein the means for attaching engages a portion of the top surface of the at least one securing piece for securing said at least one securing piece to the pool deck without said means for attaching engaging the at least one track member;

wherein the means for attaching the at least one securing piece comprises an anchor configured for insertion into the pool deck and a fastener configured for insertion through an aperture formed within the at least one securing piece and into the anchor securing said at least one securing piece.

17. The track assembly of claim 16, wherein the track member includes an under surface, and the grip arm is a first elongate grip arm formed below said under surface, wherein the contacting member is a second elongate grip arm formed below said under surface, and wherein the first elongate grip arm may be configured and dimensioned to grip the sidewall defining the first elongate recess of the securing piece.

18. The track assembly of claim 17, wherein the first and second elongate grip arms may be partially cylindrical in shape, and wherein the first elongate recess may be defined by a partially cylindrical boundary.

19. The track assembly of claim 17, wherein the first and second grip arms may be configured and dimensioned to grip the at least one securing piece therebetween.

20. The track assembly of claim 16, wherein the at least one securing piece further comprises a first side and a second side, the first elongate recess formed in the first side and a second elongate recess defined by a second sidewall formed in the second side.

21. The track assembly of claim 20, wherein the track member includes an under surface, and the grip arm is a first elongate grip arm formed below said under surface and the contacting member is a second elongate grip arm formed below said under surface, wherein the first elongate grip arm may be configured and dimensioned to grip the sidewall defining the first elongate recess and the second elongate grip arm may be configured and dimensioned to grip second sidewall defining the second elongate recess.

22. The track assembly of claim 16, wherein the at least one securing piece further comprises means for splicing the track member to a second track member while the at least one securing piece resides beneath and concealed by said track member and the second track member.

23. The track assembly of claim 16, wherein the at least one securing piece further comprises an aperture formed between the top surface and the bottom surface.

24. The track assembly of claim 16, wherein the track member may be fabricated from an elastic material for resiliently expanding the grip arm over the top surface of the at least one securing piece and then snap-fitting into the first elongate recess.

25. The track assembly of claim 16, wherein the sidewall defining the first elongate recess comprises a concave surface separating the top surface from the bottom surface.

26. The track assembly of claim 16, wherein the sidewall of the at least one securing piece is located entirely between the top surface and the bottom surface of said at least one securing piece.

27. A track assembly for guiding the placement and removal of a flexible pool cover, said track assembly comprising:

at least one attachment splice configured and dimensioned for being secured to each side of a pool deck, said at least one attachment splice having a top surface and a bottom surface, and a sidewall defining a first elongate recess;

means for attaching the at least one attachment splice to the pool deck; and at least one track member located on each side of the pool deck and having an upper surface, an under surface, a contacting member, and a grip arm for matingly engaging the sidewall defining the first elongate recess in a snap-fit and a channel for guiding a movement piece of the flexible pool cover;

wherein the track member may be secured to the at least one attachment splice by deflecting the grip arm outwardly over the top surface of the at least one attachment splice and snapping the grip arm downwardly into the first elongate recess securing the track member to the attachment splice;

wherein the means for attaching engages a portion of the top surface of the at least one attachment splice for securing said at least one attachment splice to the pool deck without said means for attaching engaging the at least one track members;

wherein the means for attaching the at least one attachment splice comprises an anchor configured for insertion into the cool deck and a fastener configured for insertion through an aperture formed within the at least one attachment splice and into the anchor securing said at least one attachment splice.

28. The track assembly of claim 27, wherein the grip arm is a first elongate grip arm formed below said under surface and the contacting member is a second elongate grip arm formed below said under surface, and wherein the first elongate grip arm may be configured and dimensioned to grip the first elongate recess of the attachment splice.

29. The track assembly of claim 28, wherein the first and second elongate grip arms may be partially cylindrical in shape, and wherein the first elongate recess may be defined by a partially cylindrical boundary.

30. The track assembly of claim 28, wherein the first and second grip arms may be configured and dimensioned to grip the at least one attachment splice therebetween.

31. The track assembly of claim 27, wherein the at least one attachment splice further comprises a first side and a second side, the first elongate recess formed in the first side and a second elongate recess defined by a second sidewall formed in the second side.

32. The track assembly of claim 31, wherein the grip arm is a first elongate grip arm formed below said under surface and the contacting member is a second elongate grip arm formed below said under surface, wherein the first elongate grip arm may be configured and dimensioned to grip the sidewall defining the first elongate recess and the second elongate grip arm may be configured and dimensioned to grip the second sidewall defining the second elongate recess.

33. The track assembly of claim 27, wherein the at least one attachment splice further comprises means for splicing the track member to a second track member while the at least one attachment splice resides beneath and concealed by said track member and the second track member.

34. The track assembly of claim 27, wherein the at least one attachment splice further comprises an aperture formed between the top surface and the bottom surface.

35. The track assembly of claim 27, wherein the track member may be fabricated from an elastic extruded material for resiliently expanding the grip arm over the top surface of the at least one attachment splice and then snap-fitting into the first elongate recess.

36. The track assembly of claim 27, wherein the sidewall defining the first elongate recess may be configured having a concave surface separating the top surface from the bottom surface.

37. The track assembly of claim 27, wherein the sidewall of the at least one attachment splice is located entirely between the top surface and the bottom surface of said at least one attachment splice.

38. A track assembly for guiding the placement and removal of a flexible pool cover, said track assembly comprising:

at least one attachment splice configured and dimensioned for being secured to each side of a pool deck, said at least one attachment splice having a top surface and a bottom surface, and a sidewall defining a first elongate recess;

means for attaching the at least one attachment splice to the pool deck; and at least one track member located on each side of the pool deck and having an upper surface, an under surface, a contacting member, and a grip arm for matingly engaging the sidewall defining the first elongate recess in a snap-fit and a channel for guiding a movement piece of the flexible pool cover;

wherein the track member may be secured to the at least one attachment splice by deflecting the grip arm outwardly over the top surface of the at least one attachment splice and snapping the grip arm downwardly into the first elongate recess securing the track member to the attachment splice;

wherein the at least one attachment splice further comprises a beveled edge having a beveled surface for permitting the track member to snap-fit more easily over the at least one attachment splice.

39. The track assembly of claim 38, wherein the beveled surface comprises a width that is between the range of 15% to 20% of a thickness of the attachment splice.

40. The track assembly of claim 39, wherein the width of the beveled surface is 18% of the thickness of the attachment splice.

41. The track assembly of claim 38, wherein the bevel surface forms an acute angle with respect to the bottom surface of the attachment splice that is between a range of 40 degrees to 50 degrees.

42. The track assembly of claim 41, wherein the acute angle is 45 degrees.

43. A method of assembling a track system for guiding the placement and removal of a flexible pool cover, said method comprising the steps of:

positioning at least one securing piece on each side of a pool deck;

securing the securing piece to the pool deck; and snap-fitting at least one track member downwardly onto the at least one securing piece on each side of the pool deck to thereby cover at least a portion of said at least one securing piece such that the securing piece intercouples the track member to each side of the pool deck.

44. The method of assembling a track system of claim 43, wherein positioning at least one securing piece further comprises providing said at least one securing piece having an aperture and at least one elongate recess.

45. The method of assembling a track system of claim 44, wherein the method further comprises inserting a fastener through the aperture of the at least one securing piece and into the pool deck to secure said at least one securing piece to the pool deck.

46. A method of assembling a track system for guiding the placement and removal of a flexible pool cover, said method comprising the steps of:

forming a plurality of holes in a surface of a pool deck;

providing a plurality of anchors and inserting one of the plurality of anchors into each of the plurality of holes such that each anchor may be substantially flush with the surface of the pool deck;

positioning a plurality of securing pieces on the surface of the pool deck such that each of the plurality of securing pieces may be positioned over each of the plurality of holes, said plurality of securing pieces each having an aperture and at least one recess formed on each side of the securing pieces;

providing a plurality of fasteners and inserting one of the plurality of fasteners through the aperture of each of the plurality of securing pieces and into the corresponding anchor such that the plurality of securing pieces may be secured to the pool deck; and snap-fitting at least one track member on each side of the pool deck downwardly onto the plurality of securing pieces for covering said plurality of securing pieces and each of the accompanying fasteners.

47. A track assembly for guiding the placement and removal of a flexible pool cover, said track assembly comprising:

a plurality of attachment splices configured and dimensioned for attachment to a pool deck, each of said attachment splices having a top surface and a bottom surface with an aperture formed between the top surface and the bottom surface, and a first sidewall defining a first elongate recess and a second sidewall defining a second elongate recess, each of said attachment splices further having a first side and a second side, the first elongate recess formed in the first side and the second elongate recess formed in the second side;

means for attaching the attachment splices to the pool deck, wherein the means for attaching the attachment splices comprises an anchor configured for insertion into the pool deck and a fastener configured for insertion through the aperture formed within each of the attachment splices and into the anchor securing said attachment splices; and a first and second track member each having a first grip arm and a second grip arm for matingly engaging the first sidewall defining the first elongate recess and the second sidewall defining the second elongate recess;

wherein said first sidewall and said second sidewall, defining the first elongate recess and the second elongate recess, respectively, comprise a partially cylindrical boundary;

wherein said first track member comprises an under surface, the first grip arm and the second grip arm formed below said under surface;

wherein said first elongate grip arm is configured and dimensioned to contact the first sidewall defining the first elongate recess, and said second elongate grip arm is configured and dimensioned to contact the second sidewall defining the second elongate recess;

wherein said first and second elongate grip arms may be partially cylindrical in shape;

wherein said first and second grip arms may be configured and dimensioned to grip a single attachment splice therebetween;

wherein each of said attachment splices further comprises a beveled edge having a beveled surface for permitting the first track member to snap-fit more easily over the at least securing piece;

wherein said beveled surface comprises a width that is between a range of 15% to 20% of a thickness of the securing piece;

wherein said bevel surface forms an acute angle with respect to the bottom surface of the securing piece that is between a range of 40 degrees to 50 degrees; and wherein each track member is fabricated from an elastic material for resiliently causing the first and second grip arms to deflect outwardly against the at least one attachment splice to thereby enable each track member to snap downwardly, with the first and second grip arms snapping into the first and second elongate recesses, creating a snap-fit.

* * * * *

UNITED STATES PATENT AND TRADEMARK OFFICE

CERTIFICATE OF CORRECTION

PATENT NO. : 7,171,703 B2
APPLICATION NO. : 10/267464
DATED : February 6, 2007
INVENTOR(S) : Mathis It is certified that error appears in the above-identified patent and that said Letters Patent is hereby corrected as shown below:

On the Title Page, (75), Inventor:, after "Mathis", delete "West Jordan, UT(US)" and add --Draper, UT (US); David B. Dalton, Heber, UT (US); Matthew D. Greeff, Kingsville, MO (US)--

Signed and Sealed this

Twenty-seventh Day of November, 2007

JON W. DUDAS
*Director of the United States Patent and Trademark Office*